US005806037A

United States Patent [19]

Sogo

[11] Patent Number: 5,806,037

[45] Date of Patent: Sep. 8, 1998

[54] VOICE SYNTHESIS SYSTEM UTILIZING A TRANSFER FUNCTION

[75] Inventor: Akira Sogo, Hamamatsu, Japan

[73] Assignee: Yamaha Corporation, Hamamatsu, Japan

[21] Appl. No.: 411,909

[22] Filed: Mar. 29, 1995

[30] Foreign Application Priority Data

Mar. 29, 1994 [JP] Japan ..... 6-082462

[51] Int. Cl.[6] ..... G10L 9/04

[52] U.S. Cl. ..... 704/268; 704/261; 704/207; 704/209

[58] Field of Search ..... 395/2.67, 2.16, 395/2.77, 2.7; 704/207, 208, 209, 258, 261, 264, 266, 268, 269

[56] References Cited

U.S. PATENT DOCUMENTS

| | | | |
|---|---|---|---|
| 4,344,148 | 8/1982 | Brantingham et al. | 395/2.67 |
| 4,809,271 | 2/1989 | Kondo et al. | 370/110.1 |
| 5,007,094 | 4/1991 | Hsueh et al. | 381/47 |
| 5,091,945 | 2/1992 | Kleijn | 381/36 |
| 5,113,449 | 5/1992 | Blanton et al. | 381/51 |

*Primary Examiner*—Richemond Dorvil
*Attorney, Agent, or Firm*—Pillsbury Madison & Sutro LLP

[57] ABSTRACT

A voice synthesis system is fundamentally configured by a sound-source model, which simulates human voices and the like, and a voice-path model which simulates properties of voice paths between vocal cords and lips. The sound-source model is embodied by a code book which stores a plurality of code words, representative of waveform patterns, with respect to each of the voices. Each of the code words is selected by an information index. The voice-path model is embodied by a full-pole synthesis filter whose characteristic curve provides multiple poles, each of which is represented by polar coordinates. There is further provided a pitch filter and an all-pass filter. Data representative of the code word selected is supplied to the pitch filter, in which a first delay time, set by a number of delay-time units, is imparted to the data. Then, the all-pass filter imparts a second delay time, which is smaller than the delay-time unit, to the data in response to pitch-variation information. Those filters are provided to perform a fine adjustment of the pitch of the data. Thereafter, the full-pole synthesis filter performs filtering processing on the data in accordance with a coefficient which is set in response to the polar coordinates and pitch-variation information. Thus, signals indicative of synthesized sounds are produced by the full-pole synthesis filter.

13 Claims, 6 Drawing Sheets

VOICE SYNTHESIS SYSTEM UTILIZING A TRANSFER FUNCTION

BACKGROUND OF THE INVENTION

1. Field of the Invention

The present invention relates to a voice synthesis system which provides a voice source for karaoke systems, computer music systems, game devices, electronic musical instruments and the like.

2. Prior Art

Conventionally, waveform coding technology is used to convert voice waveforms into a coded form by using pulse code modulation (i.e., PCM), adaptive differential pulse code modulation (i.e., ADPCM) and adaptive delta modulation (i.e., ADM), so that voice information representative of the voice waveforms coded is transmitted through networks or is stored by so-called "package media". In electronic musical instruments, the ADM, ADPCM or the like is used to reduce the amount of musical tone data, so that a reduced amount of musical tone data is stored by memories. Thereafter, the known technology performs reproduction on the musical tone data by using pitches, tone colors and tone volumes which are designated by musical-tone designation data given from a performer.

Meanwhile, an analytical-synthesis coding method provides a highly efficient coding method. As the analytical-synthesis coding method, a vector quantization method is known. The vector quantization method does not perform quantization on each value of sampling representative of waveforms or spectrum-envelope parameters but the vector quantization performs quantization on a set of multiple values of sampling so as to represent them as one code. Herein, the waveform is divided into plural sections corresponding to intervals of time in sampling, so that each section of the waveform is presented as a waveform pattern which is represented by one code in accordance with the vector quantization. In order to do so, a variety of waveform patterns are stored by memories or the like in advance, and codes are assigned respectively to the waveform patterns. Herein, a set of various waveform patterns are called a "code word"; and a so-called "code book" stores a table showing correspondence between the codes and code words. An input waveform is compared with each code word in the code book, by every interval of time which is determined in advance. In other words, a matching operation is performed on the input waveform with respect to each of the code words of the code book. If a certain code word has a highest degree of matching with respect to the input waveform, the input waveform is represented by a code corresponding to the certain code word.

FIG. 12 is a systematic figure showing a concept in design for a voice synthesis model. In general, human voices can be synthesized by a sound-source model 101 and a voice-path model 102 using pitches (represented by 'coefficients') and amplitude information. Relationships of vibrations of voice cords with noise sources can be classified into a variety of sound-source patterns, each of which is embodied by the sound-source model 101. Properties of the voice-path model 102 depend upon characteristics of the voice path, provided between the voice cords and lips, through which sound waves are transmitted. Thus, the code book, which specifies the sound-source pattern for the waveform, is used as the sound-source model 101. Pitches of the voices are determined by a pitch filter. In addition, an adequate synthesis filter is used as the voice-path model 102.

In general, a transfer function 'H(z)' of the voice-path model 102, which neglects nasal sounds, is represented by an equation (1). which is a full-pole-type transfer function neglecting zero point on 'z' plane.

$$H(z)=1/(1-\Sigma_i \alpha_i z^{-i}) \quad (1)$$

The conventional analytical-synthesis coding method as described above is- designed in such a way that a coefficient $\alpha_i$ of a full-pole synthesis filter is stored directly or is transmitted directly. Therefore, when varying the pitch, the conventional technology requires three-stage processing as follows:

At first, polar coordinates for all of the poles of the full-pole synthesis filter are computed. Then, the polar coordinates of each pole are, moved in response to an amount of pitch variation. Thereafter, the full-pole synthesis filter is re-structured.

Thus, the conventional technology is disadvantageous in that complicated processing is required.

In addition, a pitch filter is normally configured by a tapped delay circuit. In that sense, the pitch filter can merely offer resolution corresponding to one tap of the delay circuit.

The code book described before is used as sound source information which drives the full-pole synthesis filter and is made in a table form which stores the waveform patterns. Such simple table form is disadvantageous in that the time axis cannot be changed. Thus, there is a problem that the conventional technology lacks flexibility in the pitch variation.

SUMMARY OF THE INVENTION

It is an object of the present invention to provide a voice synthesis system which requires a remarkably reduced amount of information and which has flexibility in the pitch variation.

The present invention relates to a voice synthesis system providing a brand-new voice coding method by which the transmission rate and the storage capacity required can be reduced. The present invention is applicable to voice source devices, used by on-line karaoke systems and the like, which are designed to synthesize voices (or musical tones) based on receiving data transmitted through transmission paths. In addition, the present invention is applicable to other types of voice source devices, used by the karaoke systems, computer music systems and game devices, which are designed to synthesize voices (or musical tones) based on data stored by storage media such as magnetic tapes, magnetic disks and solid-state memories. Further, the present invention is applicable to other types of voice source devices, used by electronic musical instruments and the like, which are designed to synthesize voices (or musical tones) based on data given by users in real time. Incidentally, the term "voices" represents human voices or human speech as well as acoustic sounds, musical tones and other sounds.

A voice synthesis system according to the present invention is fundamentally configured by a sound-source model, which simulates human voices and the like, and a voice-path model which simulates properties of voice paths between vocal cords and lips. The sound-source model is embodied by a code book which stores a plurality of code words, representative of waveform patterns, with respect to each of the voices. Each of the code words is selected by an information index. The voice-path model is embodied by a full-pole synthesis filter whose characteristic curve provides multiple poles, each of which is represented by polar coordinates. There is further provided a pitch filter and an all-pass filter. These filters are provided to perform a fine adjustment of the pitch of the data. Thereafter, the full-pole synthesis filter performs filtering processing on the data in accordance with a coefficient which is set in response to the polar coordinates and pitch-variation information. Thus, signals indicative of synthesized sounds are produced by the full-pole synthesis filter.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENTS

Now, preferred embodiments of the present invention will be described in detail with reference to the drawings, wherein parts equivalent to those of some drawings are designated by the same numerals; hence, the description thereof will be sometimes omitted.

Figure 1:
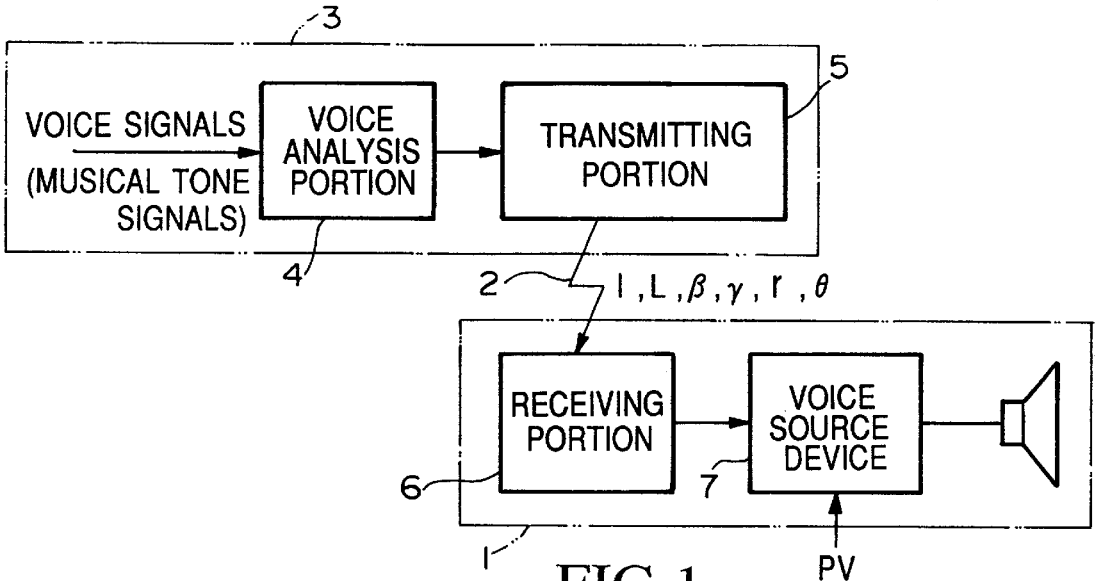
FIG. 1 is a block diagram showing a voice synthesis system according to a first embodiment of the present invention.

FIG. 1 is a block diagram showing the overall system configuration of a voice synthesis system according to a first embodiment of the present invention. This system is fundamentally configured in such a way that voice signals are converted into a coded form by the analytical-synthesis coding method in a transmitting station; and then, data representative of the coded voice signals are transmitted to a receiving station through communication lines. This system is applied to the on-line karaoke systems using the voice sources.

In FIG. 1, a receiving station 1 is connected with a transmitting station 3 through a communication line 2. The transmitting station 3 is configured by a voice analysis portion 4 and a transmitting portion 5. The voice analysis portion 4 is provided to compute code-book information 'I'. pitch information 'L', gains 'β', 'τ' and polar coordinates 'r', 'θ'. Herein, the code-book information I is used as sound-source data; the pitch information L is used to determine pitches for sounds to be produced; the gains β and τ are used to determine amplitudes of voices; and the polar coordinates r, θ (according to polar-coordinate representation) are used to represent poles of the transfer function of the full-pole synthesis filter. All of the data representative of the above-mentioned I, L, β, τ, r and θ are transmitted by the transmitting portion 5 to the receiving station 1 through the communication line 2. The receiving station 1 is configured by a receiving portion 6 and a voice-source device 7. Herein, the receiving portion 6 receives the data I, L, β, τ, r and θ. The voice-source device 7 synthesizes voice signals based on the data received by the receiving portion 6 as well as pitch-variation information 'PV' which is set at the receiving station 1.

Figure 2:
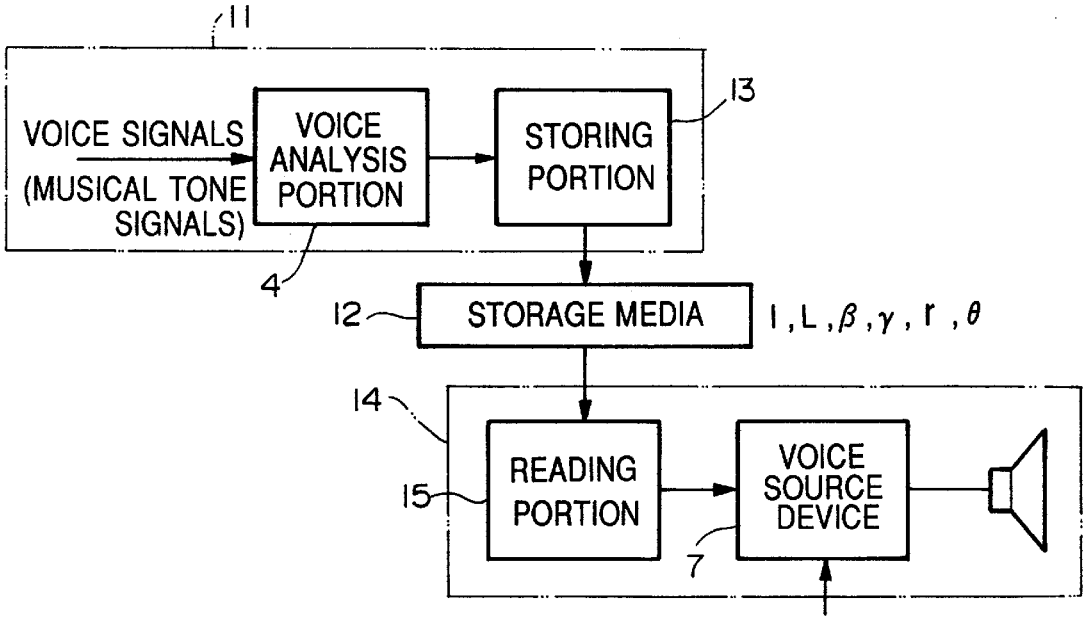
FIG. 2 is a block diagram showing a voice synthesis system according to a second embodiment of the present invention.

FIG. 2 is a block diagram showing an overall system configuration of a voice synthesis system according to a second embodiment of the present invention. This system is designed to convert voice signals into a coded form by using the analytical-synthesis coding method. Then, data representative of the coded voice signals are stored in disk media such as compact disks (CD), laser disks (LD), magnetic disks (MD) and floppy disks (FD); they are stored on magnetic tapes such as digital audio tapes (DAT) and digital compact cassette (DCC); or they are stored in storage media such as memories. Then, the data are read out from those media on demand so as to synthesize voice signals and the like.

The voice synthesis system of FIG. 2 is fundamentally configured by a storage device 11, storage media 12 and a reproduction device 14. The storage device 11 is configured by a voice analysis portion 4, which is similar to that shown in FIG. 1, and a storing portion 13. A variety of data I, L, β, τ, r and θ outputted from the voice analysis portion 4 are supplied to the storing portion 13 in which they are modulated on demand and by which they are written into the storage media 12. The reproduction device 14 is configured by a reading portion 15 and a voice source device 7 which is similar to that shown in FIG. 1. The reading portion 15 reads out necessary data, selected from among the data I, L, β, τ, r and θ, from the storage media 12. Then, the voice source portion 7 synthesizes musical tone signals based on the data, read by the reading portion 15, as well as pitch-variation information PV which is set at the reproduction device 14.

Figure 3:
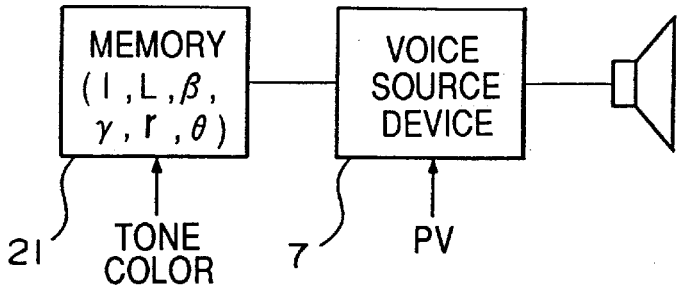
FIG. 3 is a block diagram showing a voice synthesis system according to a third embodiment of the present invention.

FIG. 3 is a block diagram showing an overall system configuration of a voice synthesis system according to a third embodiment of the, present invention. This voice synthesis system is designed to cope with properties of electronic musical instruments. The voice synthesis system of FIG. 3 is fundamentally configured by a memory 21 and a voice source device 7. The memory 21 is configured by a read-only memory (i.e., ROM) or the like. Herein, the data I, L, β, τ, r and θ are obtained by analyzing a plurality of musical tones (or voices) in advance, so that combinations of them are stored in the memory 21. One set of data are selected in the memory 21 in accordance with tone-color designation information. The voice source device 7 synthesizes musical tones (or voices) based on a selected set of data as well as pitch-variation information PV which is designated by operating a keyboard or the like.

When applying the third embodiment to electronic musical instruments providing a sampling function, the voice synthesis system of FIG. 3 is modified as follows:

The memory 21 is configured by a random-access memory (i.e., RAM). There are further provided a voice analysis portion, which computes the data I, L, $\beta$, $\tau$, r and $\theta$ based on musical tones (or voices) inputted thereto, and a storing portion by which data are stored into the memory 21.

In the voice synthesis systems described above, information to be transmitted or information to be stored in the storage media is a simple set of the code-book information I, pitch information L, gains $\beta$, $\tau$, and polar coordinates r, $\theta$ for the poles of the full-pole synthesis filter. Thus, an amount of data transmitted or an amount of data stored can be reduced remarkably. In addition, information which is required by the voice source device 7 is merely the pitch-variation information PV which determines how much the pitch should be varied from a fundamental pitch.

The code-book information I presents codes which specify multiple code words, wherein the code word is set in a form of time function which will be described later. The pitch information L is information representative of a pitch of a voice and is used as a parameter which determines the number of delay stages of a pitch filter, wherein details of the pitch filter will be described later. The gains $\beta$ and $\tau$ are used as parameters which control amplitudes of voices. The polar coordinates r and $\theta$ of the full-pole synthesis filter present information which is used to compute a coefficient $\alpha$ for the full-pole synthesis filter corresponding to the voice-path model. In addition, those coordinates are used as parameters by which the coefficient $\alpha$ is easily created based on the pitch-variation information PV. The coefficient a created is used as a parameter which controls a voice signal by a unit of frame of about 20 msec, for example.

Next, details of the analytical-synthesis coding method, which is employed by the voice analysis portion 4 in order to produce the aforementioned information, will be described.

(1) Polar coordinates r, $\theta$ of the full-pole synthesis filter

Characteristics of the full-pole synthesis filter approximately represent spectrum-envelope characteristics of voices which correspond to properties of the voice paths. Transfer function H(z) of this full-pole synthesis filter can be represented by an equation (2) as follows:

$$\begin{aligned} H(z) &= 1/(1-\Sigma_i\alpha_i z^{-i}) \\ &= 1/A(z) \end{aligned} \tag{2}$$

Figure 4:
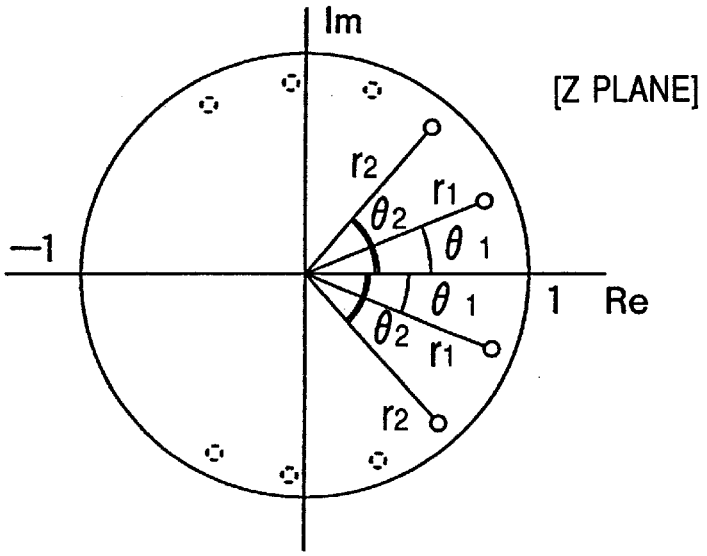
FIG. 4 is a drawing which is used to explain polar coordinates in a transfer function of a full-pole synthesis filter used by the voice synthesis system.
Figure 5:
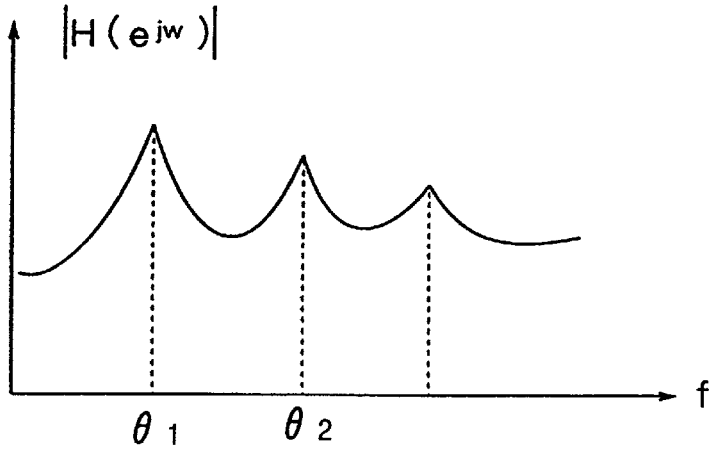
FIG. 5 is a graph showing an amplitude-frequency characteristic of the transfer function of the full-pole synthesis filter.

In the above equation (2), the filter coefficient $\alpha_i$ is varied responsive to the pitch. For this reason, in the present invention, the transfer function H(z) is specified by root where A(z)=0; in other words, the transfer function H(z) is specified by a pole represented by polar coordinates $r_i$, $\theta_i$ on z plane as shown by FIG. 4. An example of amplitude-frequency characteristic of the transfer function is shown in FIG. 5. Herein, symbols $\theta_1$ and $\theta_2$ represent formant frequencies.

If $r_1\exp(\pm j\theta_1)$, $r_2\exp(\pm j\theta_2)$, . . . are roots for A(z)=0, an equation for A(z) can be expanded as follows:

$$\begin{aligned} A(z) &= 1-\Sigma_i\alpha_i z^{-i} \\ &= 1-(\alpha_1 z^{-1}+\alpha_2 z^{-2}+\ldots) \\ &= (1-2r_1\cos\theta_1 z^{-1}+r_1^2 z^{-2})\cdot \\ &\quad (1-2r_2\cos\theta_2 z^{-1}+r_2^2 z^{-2})\cdot \\ &\quad (\quad \ldots \quad \ldots \quad ) \\ &\quad \ldots \quad \ldots \\ &= 1-(2r_1\cos\theta_1+2r_2\cos\theta_2+\ldots)z^{-1}+ \\ &\quad (r_1^2+4r_1r_2\cos\theta_1\cos\theta_2+r_2^2+\ldots)z^{-2}- \\ &\quad (2r_1r_2^2\cos\theta_1+2r_1^2r_2\cos\theta_2+\ldots)z^{-3} \end{aligned}$$

Therefore, if the root for A(z)=0 is known in advance, the coefficient $\alpha_i$ for the full-pole synthesis filter can be computed as follows:

$$\alpha_1=2r_1\cos\theta_1+2r_2\cos\theta_2+\ldots$$

$$\alpha_2=-r_1^2-4r_1r_2\cos\theta_1\cos\theta_2-r_2^2+\ldots$$

Now, auto-correlation and covariance in linear predictive coding method (known as "LPC") is used to analyze musical tone signals by every short-time frame (e.g., by every 20 msec or so), so that the coefficient $\alpha_i$ for the full-pole synthesis filter is computed.

Figure 6:
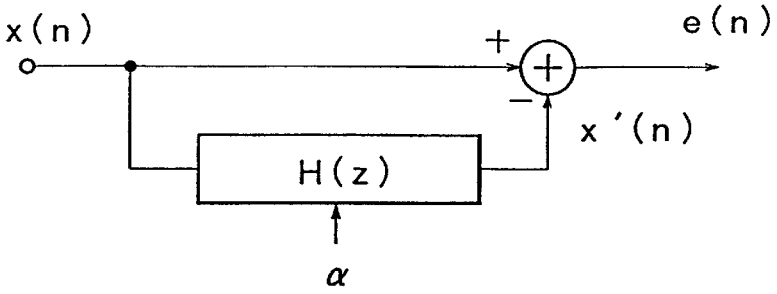
FIG. 6 is a system diagram showing a prediction model of the full-pole synthesis filter.

In the present invention, a prediction model as shown by FIG. 6 is used to compute the filter coefficient. Herein, the filter coefficient $\alpha_i$ is computed to meet the condition where error power e(n), corresponding to a difference between input voice x(n) and predictive output voice x'(n), becomes equal to zero. The predictive output voice x'(n) is computed by an equation (5) as follows:

$$x'(n)=\Sigma^p_{i=1}\alpha_i x(n-i) \tag{5}$$

Thus, if '160' samples of data are extracted in a frame period of 20 msec where sampling frequency 'Fs' equals 8 KHz, error power 'E' (where $E=\Sigma e_i$) is computed by an equation (6) as follows:

$$\begin{aligned} E &= \sum_{n=0}^{m}\{x(n)-x'(n)\}^2 \\ &= \sum_{n=0}^{m}\left\{x(n)-\sum_{i=1}^{p}\alpha_i x(n-i)\right\}^2 \end{aligned} \tag{6}$$

where 'm'=159.

A value of the coefficient $\alpha_i$ which minimizes the error power E can be computed by effecting partial differentiation, using $\alpha_i$, on the above equation (6). An equation (7) is obtained by effecting the partial differentiation on the equation (6).

$$\Sigma^m_{n=0}x(n)x(n-j)=\Sigma^p_{i=1}\alpha_i\Sigma^m_{n=0}x(n-i)x(n-j) \tag{7}$$

where 'm'=159.

Now, auto-correlation function 'R(j)' is represented by an equation (8) as follows:

$$R(j)=\Sigma^m_{n=0}x(n)x(n-j) \tag{8}$$

where j=0, 1, 2, . . . , p and 'm'=159.

By using the above equation (8), the equation (7) can be rewritten into an equation (9) as follows:

$$R(j)=\Sigma^p_{i=1}\alpha_i R(i-j) \tag{9}$$

By solving the above equation, it is possible to compute the filter coefficient $\alpha_i$. Then, the filter coefficient $\alpha_i$ computed is put into the aforementioned equation (2); and by effecting factorization on "A(z)=0", it is possible to obtain coordinates $r_1$, $r_2$, $\theta_1$ and $\theta_2$ for roots of A(z)=0.

(2) Pitch information L and pitch gain $\tau$

As for the pitch information L and pitch gain $\tau$, a previous sound-source output signal is used to temporarily reproduce a signal by a pitch filter configured by a tap-variable delay circuit. The present embodiment is designed based on a theory in which the pitch is approximately equivalent to period; in other words, if the pitch 'L' is given, a signal corresponding to that pitch is likely to have a period 'L'. By using a previous sound-source output signal 'V(n)', the pitch filter is used to reproduce a signal represented by 'V(n−L)', wherein the signal reproduced is approximately equal to the previous sound-source signal because of the theory described above. Then, weighting, relating to sense of hearing, is performed on input signals to obtain the error power E by every sub-frame (e.g., 5 msec or so) so that the error power E can be minimized.

$$E=\Sigma^{M}_{n=0}[\{x(n)-\Sigma\cdot V(n-L)\}*w(n)]^2 \quad (10)$$

where 'M'=N−1.

In the above equation (10), 'x(n)' represents an input signal; 'V(n)' represents a previous sound-source output signal; and 'w(n)' represents an impulse response of a sense-of-hearing-weighting filter. In addition, a symbol "*" shows convolution computing.

Transfer function 'w(z)' for the sense-of-hearing-weighting filter is represented by an equation (11) as follows:

$$w(z)=(1-\Sigma_i\alpha_i z^{-i})/(1-\Sigma_i\alpha_i\lambda^i z^{-i}) \quad (11)$$

Herein, '$\lambda$' is set at 0.8, for example. Incidentally, the symbol '$\alpha_i$' is the filter coefficient of the full-pole synthesis filter described before.

(3) Code-book information I

The voice synthesis system of the present invention is characterized by that each of the code words contained in the code book is represented by a time-related function. In other words, a waveform of an input voice signal is divided into multiple sections each corresponding to a certain interval of time (e.g., 5 msec); and the waveform pattern of each section is represented by time function '$f_I(t)$'. As an example of a voiced sound, the code word is represented by an equation (12) as follows:

$$f_I=\Sigma_k C_I(k)\cos\omega_I(k)t \quad (12)$$

In the above equation, 'I' indicates the code-book information as an index; 't' indicates time; 'C' and '$\omega$' indicate coefficients. As the code word, a matrix for the coefficients C and $\omega$ is stored in correspondence with each index. A variety of patterns for the code word are created in advance, so that the index for the pattern which most closely matches with the waveform of the input voice signal is used as the code-book Information I. The code book should be formed not to cause deflection in distribution of patterns. Herein, a limited number of patterns, e.g., '1024' patterns, are used. Those patterns are adequately determined in such a way that the deflection can be minimized.

When obtaining the code-book information I based on the input voice signal, signals are temporarily reproduced with respect to all of the codes contained by the code book; and sense-of-hearing weighting is performed on input signals so as to compute an error power E' in accordance with an equation (13); thereafter, the error power E' is determined by every sub-frame (e.g., 5 msec) so that the error power E' will be minimized.

$$E'=\Sigma^{M}_{n=0}[\{p(n)-r_j\cdot C_j(n)*h(n)\}*w(n)]^2 \quad (13)$$

where 'M'=N−1.

In the equation (13), 'p(n)' represents a signal which is obtained by subtracting a pitch prediction signal from the input signal; '$C_j(n)$' represents a code word, having a serial number 'j', in the code book which acts like the sound source; 'h(n)' represents an impulse response of the full-pole synthesis filter; and 'w(n)' represents an impulse response of the sense-of-hearing-weighting filter. In addition, the symbol "*" indicates the convolution computing. In short, the code-book information I is the index indicating the code word $f_I(t)$ which is computed as described heretofore.

Figure 7:
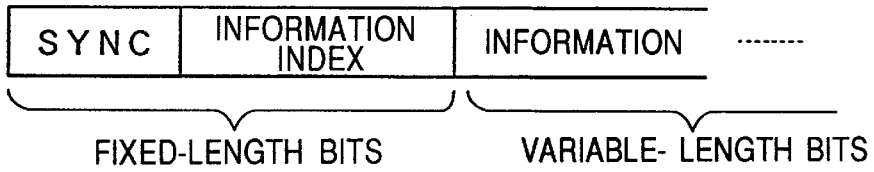
FIG. 7 is a drawing showing a MIDI format used by information to be transmitted.

The coded information described above is transmitted in a MIDI form as shown by FIG. 7 (where 'MIDI' indicates a standard for Musical Instrument Digital Interface) by every frame (e.g., 20 msec) or by every sub-frame (e.g., 5 msec). The MIDI form of FIG. 7 consists of fixed-length bits and variable-length bits which are arranged sequentially. In the fixed-length bits, there are provided a synchronization-bit pattern and an information index which are arranged sequentially. A flag represented by a single digit '0' or '1' is set as the information index. Herein, a renewal flag '1' is set when information regarding the polar coordinates of the full-pole synthesis filter, gain and the like Is renewed; and a hold flag '0' is set when the information is not renewed. Data to be renewed are placed as the variable-length bits only when the information index indicates a renewal of the data. Therefore, when information to be transmitted in the current frame is identical to information transmitted in the previous frame, transmission of that information is not made in the current frame. In a soundless mode, a code representing a soundless state is transmitted. Thus, the total amount of data to be transmitted can be reduced.

Figure 8:
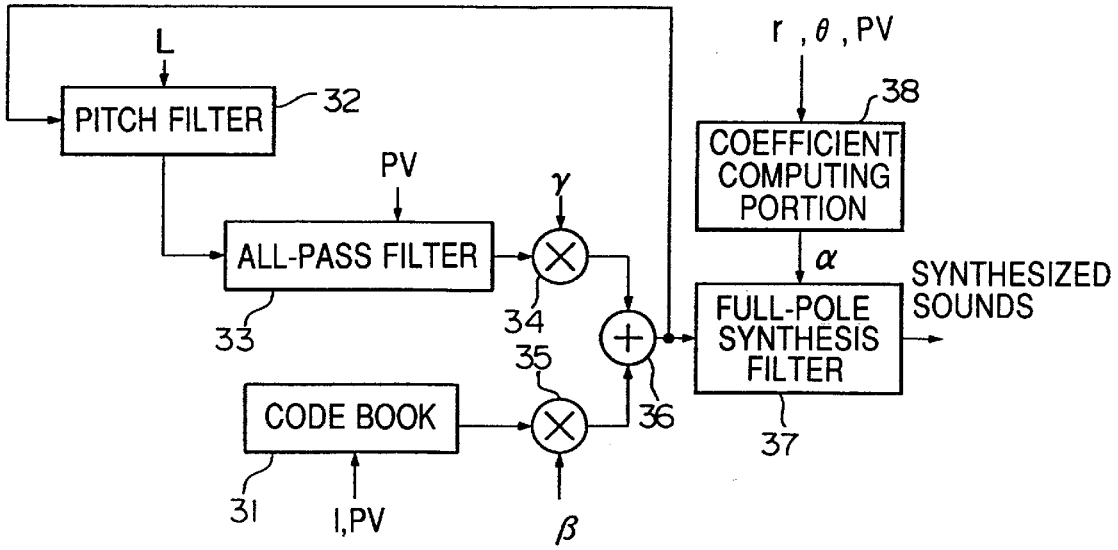
FIG. 8 is a block diagram showing a detailed configuration of a voice source device used by the voice synthesis system.

FIG. 8 is a block diagram showing a detailed configuration of a voice source device 7.

There is provided a code book 31 which specifies the sound-source pattern of the waveform corresponding to the sound-source model. Pitches of voices are determined by a pitch filter 32 and an all-pass filter 33. An output of the code book 31 is adjusted in amplitude by a multiplier 35, while an output of the all-pass filter 33 is adjusted in amplitude by a multiplier 34. Then, results of multiplication of the multipliers 34 and 35 are added together by an adder 36. The result of the addition is supplied to a full-pole synthesis filter 37, which corresponds to the aforementioned voice-path model, in which it is controlled with respect to the spectrum-envelope characteristic of the voice. A coefficient computing portion 38 computes the filter coefficient a based on the polar coordinates r and $\theta$. The filter coefficient $\alpha$ computed is supplied to the full-pole synthesis filter 37.

When the code-book information I is supplied to the voice source device 7, the time function $f_I(t)$ of the index I designated is read from the code book 31. If no pitch variation occurs, in other words, if no pitch-variation information PV is given, values representing "t=0, 1, 2, . . ." are put into the time function. When the pitch is increased by 1%, values representing "t=0, 1.01, 2.02, 3.03, . . ." are put into the time function. By changing the value of 't' to be put into the time function, it is possible to obtain a code word corresponding to the pitch variation.

Figure 9:
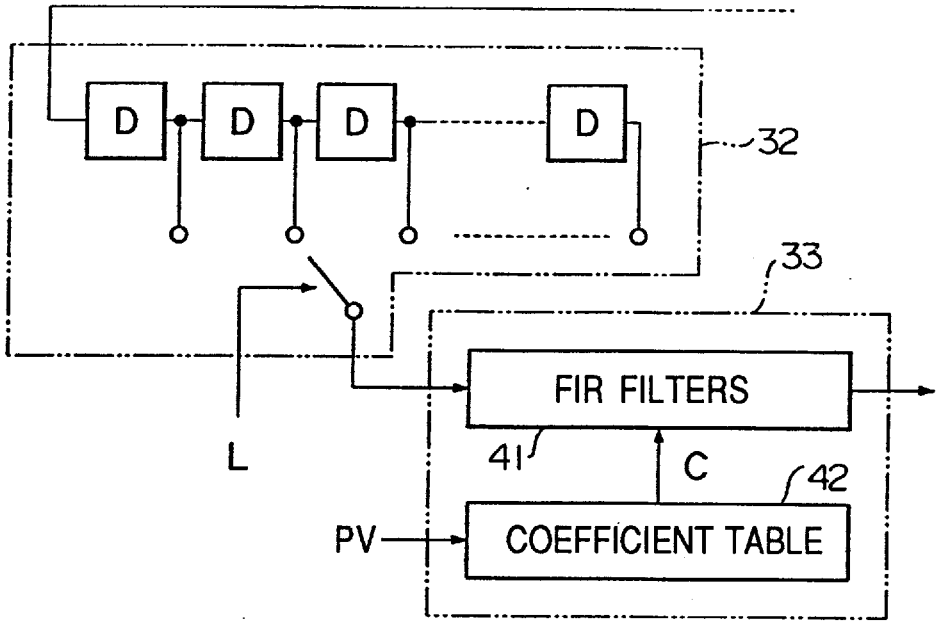
FIG. 9 is a block diagram showing a detailed configuration of a selected part of the voice source device of FIG. 8.

The pitch of the voice is varied by the pitch filter 32 and the all-pass filter 33. Details of those filters are shown in FIG. 9. Herein, the pitch filter 32 is configured by a plurality of delay elements which are connected in series. One tap is provided at an output terminal of each delay element; therefore, the pitch filter 32 as a whole is configured by a tap-variable filter. By changing the connection of the tap, in other words, by changing the number of delay elements to be used, sampling pitch can be changed by each unit corresponding to an amount of delay of the delay element.

Figure 10:
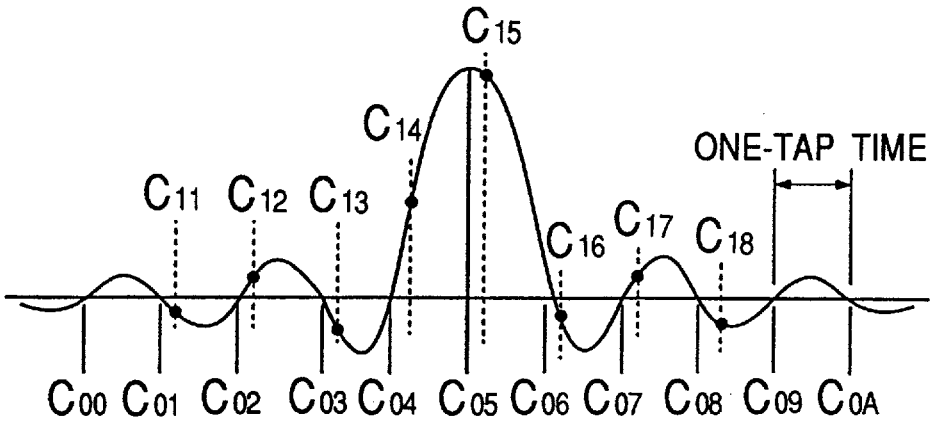
FIG. 10 is a graph showing a function which is used to compute coefficients for FIR filters in FIG. 9.

Small pitch variation, whose amount is smaller than one-tap variation in pitch of the pitch filter 32, is embodied by the all-pass filter 33. As shown in FIG. 9, the all-pass filter 33 is mainly configured by a certain number of FIR filters '41'. A coefficient 'C' for the FIR filter 41 is computed using a certain function, represented by "f(x)=(sin x)/x", whose waveform can be shown by FIG. 10, for example. In order to obtain a pitch period corresponding to an amount of delay of '50.3', an amount of delay of '50' is provided by adequately setting the tap of the pitch filter 32, while an amount of delay of '0.3' is provided by adequately setting the coefficients in the all-pass filter 33. For example, a set of coefficients $C_{01}$, $C_{02}$, . . . are changed by a set of coefficients $C_{11}$, $C_{12}$, . . . as shown in FIG. 10. In order to increase the pitch by 10% under the state where the amount of delay of '50.3' is achieved, it is necessary to shift the pitch period to that corresponding to an amount of delay of '45.7' (where 45.7=50.3/1.1). In that case, an amount of delay of '46' is provided by adequately setting the tap of the pitch filter 32, while an amount of delay of '−0.3' is provided by adequately selecting the coefficients of the all-pass filter 33. The all-pass filter of FIG. 9 has the ability of to perform fine adjustment on the pitch period within a certain range which is represented by "{(a number of FIR filters)+1}/2±0.5".

The coefficients 'C' of the all-pass filter 33 can be obtained by performing certain computation. Or, those coefficients can be provided in advance by a coefficient table 42 as shown in FIG. 9.

The sound-source signal whose pitch is adjusted as described above is supplied to the full-pole synthesis filter 37 of FIG. 8. The coefficient computing portion 38 computes the parameter $\alpha$, for the full-pole synthesis filter 37, based on the polar coordinates r, $\theta$ and the pitch-variation information PV. Herein, a variation of pitch is equivalent to a variation of formant frequency. The formant frequencies of $\theta_1, \theta_2, \ldots$ in FIG. 5 are shifted at a certain rate in accordance with a variation of pitch. For example, the formant frequency $\theta_1$ is shifted from 440 Hz to 450 Hz, while the formant frequency $\theta_2$ is shifted from 800 Hz to 818.2 Hz. In order to achieve a shift of the formant frequency, the pitch variation is represented by a "ratio", for example. By using the ratio, the coefficient of the full-pole synthesis filter 37 is re-computed based on a position of a new pole, so that the coefficient computing portion 38 computes a coefficient $\alpha_i$, for the full-pole synthesis filter 37, which has been already subjected to pitch variation. Thus, the filter 37 can be re-structured easily.

Incidentally, by adequately changing the polar coordinates r and $\theta$, it is possible to perform a special-sound reproduction.

As described heretofore, the voice synthesis systems of the present embodiment only use the code-book information, pitch information, gain information and parameter information, representative of the polar coordinates of the full-pole synthesis filter and the like, as the voice information, which should be transmitted through transmission paths, or the voice information which should be stored. Thus, as compared to the conventional system using ADPCM or the like, the present system can remarkably reduce the transmission bit rate to 4 kbps to 8 kbps, for example. In addition, the present system can flexibly cope with a pitch variation which is designated at the sound-source device.

Further, reproduction side of the present system is designed based on voice synthesis processing. Therefore, it is possible to edit a variety of voice signals based on transmitted information whose amount can be minimized. The voices can be treated as one musical-tone information used by the electronic musical instrument. Moreover, by simultaneously selecting a plurality of code books, it is possible to achieve an orchestra-like effect in which multiple persons play the same part of music.

Figure 11A:
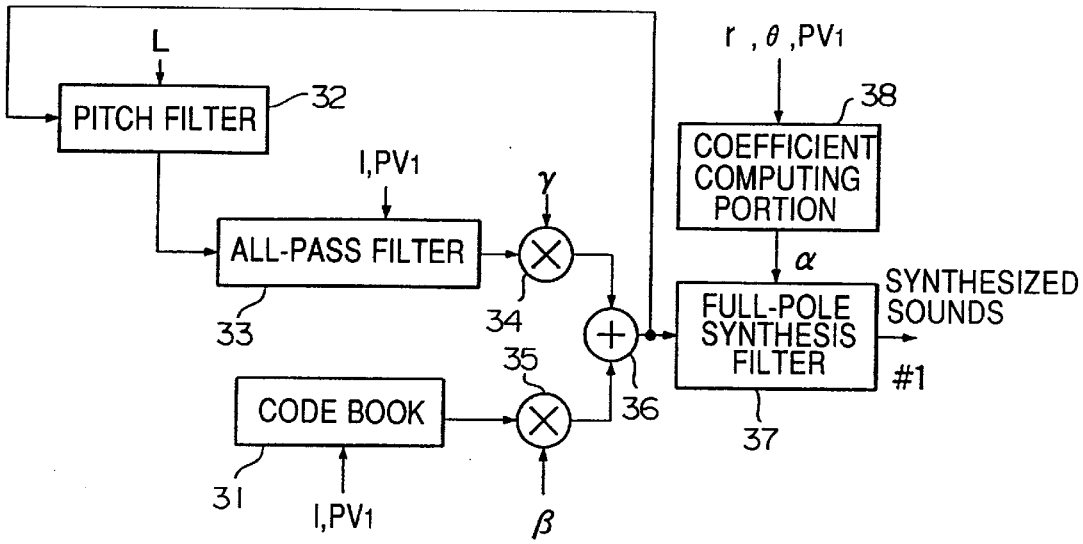
FIGS. 11A and 11B are block diagrams showing a modified example of the voice source device.
Figure 11B:
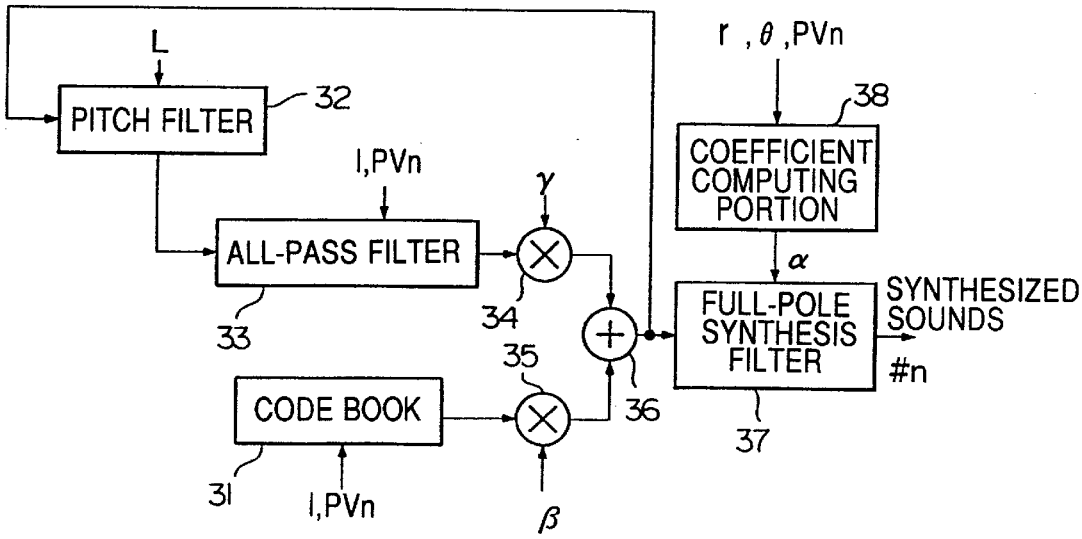
Figure 12:
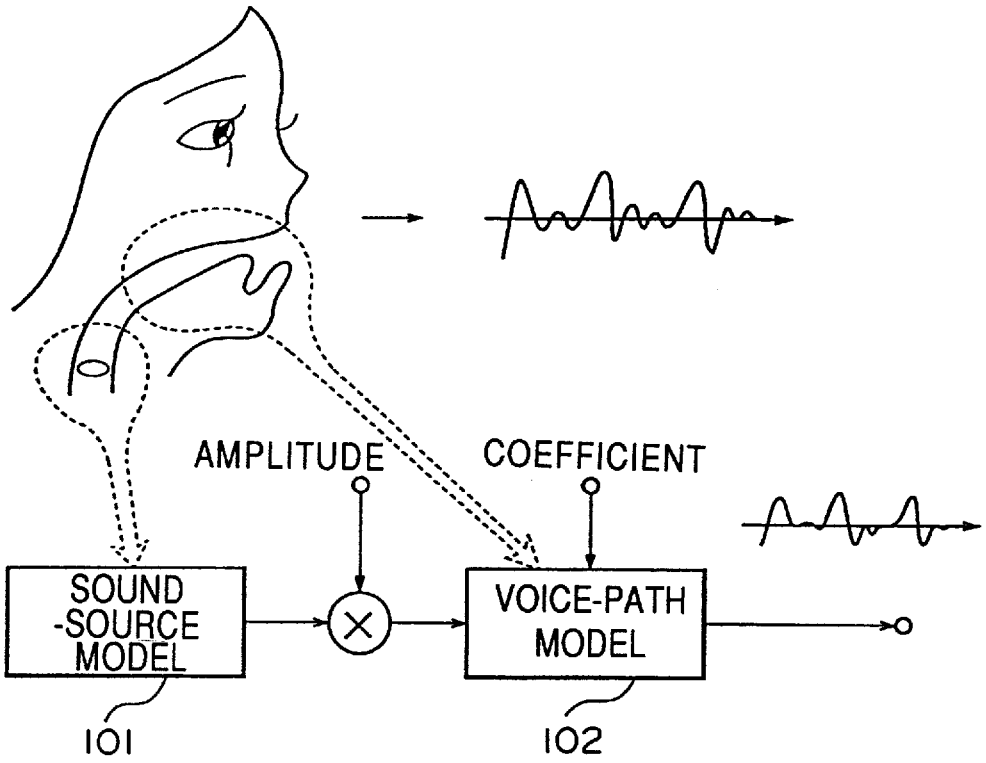
FIG. 12 is a drawing which is used to explain a concept in design for a voice synthesis system of the present invention.

The voice synthesis system can be re-designed, as shown by FIGS. 11A and 11B, to provide multiple sets of the code book 31, the pitch filter 32, the all-pass filter 33 and the full-pole filter 37 in the voice source device 7, wherein a pair of the pitch filter 32 and the all-pass filter 33 are provided to perform an adjustment of pitch. By activating this device, it is possible to simultaneously produce original sounds together with sounds whose pitches are varied as compared to pitches of the original sounds; and consequently, it is possible to produce a variety of sounds such as chorus sounds and special sounds. Moreover, the present system can be re-structured by combining multiple sound-source models and a single voice-path model or by combining a single sound-source model and multiple voice-path models. Such re-structuring can offer a variety of ways in reproduction of the voices.

As this invention may be embodied in several forms without departing from the spirit of essential characteristics thereof, the present embodiments are therefore illustrative and not restrictive, since the scope of the invention is defined by the appended claims rather than by the description preceeding them, and all changes that fall within meets and bounds of the claims, or equivalence of such meets and bounds are therefore intended to be embraced by the claims.

What is claimed is:

1. A voice synthesis comprising:

means for providing voice information which is obtained by analyzing a voice signal, the voice information at least containing polar coordinates of a transfer function means for converting the polar coordinates to filter coefficients; and voice source means, having a synthesis filter with the transfer function and responsive to the filter coefficients, for reproducing the voice signal based on the voice information, wherein the means for converting is responsive to pitch-variation information which is independent of the voice information so that the reproduced voice signal is changeable in pitch in response to the pitch-variation information independently of the voice information.

2. The voice synthesis system as defined in claim 1, wherein the voice source means includes code-book means for storing a plurality of code words representative of waveform patterns with respect to the voice signal, so that at least one code word is selected in response to an information index contained in the voice information.

3. The voice synthesis system as defined in claim 2, wherein the voice source means include pitch adjusting means for adjusting a pitch of data representative of the code word selected, in response to the pitch-variation information.

4. The voice synthesis system as defined in claim 3, wherein the pitch adjusting means includes:

a pitch filter for delaying the data by a first delay time, which is set by changing a number of delay-time units, in response to pitch information contained in the voice information; and an all-pass filter for further delaying the data by a second delay time, which is smaller than the delay-time unit, in response to the pitch-variation information.

5. The voice synthesis system as defined in claim 3, wherein the pitch adjusting means includes:

a pitch filter for delaying the data by a first delay time, which is set by changing a number of delay-time units, in response to pitch information contained in the voice information; and FIR filters, each of which performs filtering processing on the data in response to a FIR coefficient, which is set responsive to the pitch-variation information, so that the FIR filters as a whole further delay the data by a second delay time which is smaller than the delay-time unit.

6. The voice synthesis system as defined in claim 2, wherein the the synthesis filter is a full-pole synthesis filter for effecting full-pole-filtering processing on the code word, so as to produce a signal representative of a synthesized sound which corresponds to the voice signal.

7. The voice synthesis system as defined in claim 2, wherein the code-book means stores the code word which is represented by a time function.

8. The voice synthesis system as defined in claim 1, wherein the means for providing voice information is part of a transmitting station, the voice source means is part of a receiving station, and the pitch-variation information is not received from the transmitting station, but is set at the receiving station.

9. In a voice synthesis system which comprises voice source means for reproducing a voice signal based on voice information which is obtained by analyzing the voice signal, the voice source means comprising:

code-book means for storing a plurality of code words representative of waveform patterns with respect to the voice signal, so that at least one code word is selected in response to an information index contained in the voice information;

pitch adjusting means for adjusting a pitch of data representative of the code word selected, in response to pitch variation information;

coefficient computing means for computing a coefficient based on polar coordinates and the pitch-variation information, the polar coordinates including a parameter representative of a formant frequency of a transfer function, the format frequency being varied in accordance with the pitch variation information; and full-pole synthesis filter means, having a transfer function, for effecting full-pole-filtering processing, using the coefficient, on the code word, whose pitch has been adjusted by the pitch adjusting means, so as to produce a signal representative of a synthesized sound which corresponds to the voice signal.

10. A voice synthesis system according to claim 9 wherein the code-book means stores the code word which is represented by a time function.

11. A voice synthesis system according to claim 9 wherein the pitch adjusting means comprises:

a pitch filter for delaying the data by a first delay time, which is set by changing a number of delay-time units, in response to pitch information contained in the voice information; and an all-pass filter for further delaying the data by a second delay time, which is smaller than the delay-time unit, in response to the pitch-variation information.

12. A voice synthesis system according to claim 9 wherein the pitch adjusting means comprises:

a pitch filter for delaying the data by a first delay time, which is set by changing a number of delay-time units, in response to pitch information contained in the voice information; and FIR filters, each of which performs filtering processing on the data in response to an FIR coefficient, which is set responsive to the pitch-variation information, so that the FIR filters as a whole further delay the data by a second delay time which is smaller than the delay-time unit.

13. A voice synthesis system comprising:

a voice analysis device for analyzing a voice signal to generate signals representative of polar coordinates for pole locations of a transfer function of a synthesis filter, code-book information and pitch information; and a voice source device, the voice source device including:

a pitch adjuster for providing pitch-variation information;

a code-book for storing a plurality of code words representative of waveform patterns for the voice signal, at least one of the code words being selected in response to the code book information;

a pitch filter, responsive to the pitch information and to the pitch-variation information, for adjusting a pitch of data representative of the selected code word;

a coefficient computing portion for computing filter coefficients based on the polar coordinates, the filter coefficients being varied in accordance with the pitch-variation information; and a synthesis filter, having the transfer function and responsive to the filter coefficients, for filtering the pitch adjusted data representative of the selected code word to produce a synthesized sound signal corresponding to the voice signal.

* * * * *